United States Patent [19]

Suzuki

[11] Patent Number: 4,908,675

[45] Date of Patent: Mar. 13, 1990

[54] COLOR IMAGE FORMING APPARATUS HAVING A SYNCHRONIZED CONVEYOR

[75] Inventor: Minoru Suzuki, Yokohama, Japan

[73] Assignee: Ricoh Company, Ltd., Tokyo, Japan

[21] Appl. No.: 195,459

[22] Filed: May 16, 1988

Related U.S. Application Data

[63] Continuation of Ser. No. 12,486, Feb. 9, 1987, abandoned.

[30] Foreign Application Priority Data

| | | | |
|---|---|---|---|
| Feb. 10, 1986 | [JP] | Japan | 61-17931 |
| Feb. 10, 1986 | [JP] | Japan | 61-27709 |
| Aug. 20, 1986 | [JP] | Japan | 61-194858 |

[51] Int. Cl.[4] ..... G03G 15/01; G03G 15/28; G03G 21/00

[52] U.S. Cl. ..... 355/326; 355/327; 355/321; 355/234; 355/235

[58] Field of Search ..... 355/3 BE, 16, 3 TR, 355/8, 4, 3 SH, 14 SH, 14 FU, 14 TR, 14 R, 3 DR, 3 FU, 232, 234, 235, 277, 295

[56] References Cited

U.S. PATENT DOCUMENTS

| | | | |
|---|---|---|---|
| 3,794,417 | 2/1974 | Machmer | 355/14 F UX |
| 4,025,182 | 5/1977 | Goel | 355/4 |
| 4,080,053 | 3/1978 | Friday | 355/3 TR |
| 4,126,389 | 11/1978 | Ikeda et al. | 355/8 |
| 4,135,927 | 1/1979 | Draugelis et al. | 355/8 |
| 4,171,901 | 10/1979 | Takizawa et al. | 355/8 |
| 4,336,994 | 6/1982 | Banton | 355/8 |
| 4,660,957 | 4/1987 | Ueda et al. | 355/8 |
| 4,745,435 | 5/1988 | Sakata et al. | 355/14 F UX |

FOREIGN PATENT DOCUMENTS

| | | | |
|---|---|---|---|
| 0135880 | 10/1980 | Japan | 355/3 BE |

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

An image forming apparatus has a reciprocally movable document support table for supporting a document to be copied and a conveyor belt movable in directions opposite to those of the movement of the document support table in synchronism therewith. The conveyor belt conveys an image transfer sheet onto which toner images will be transferred in superimposed relation from a photosensitive body. After the toner images have been transferred, they are fixed to the image transfer sheet by an image fixing device. After the toner image transfer, the conveyor belt can be driven at a speed equal to the speed of sheet transfer by the image fixing device. Driving power transmitted from the table driving system to the conveyor belt is shut off while the document support table is moving for a distance corresponding to a period of time from after the document support table starts moving and the photosensitive body starts being exposed to until the image starts being transferred from the photosensitive body onto the image transfer sheet, and thereafter the conveyor belt is driven in synchronism with the document support table. When successive images are transferred onto the image transfer sheet in superimposed relation such as to produce a colored copy, the conveyor belt is moved in synchronism with the document support table. When a single image is transferred onto the image transfer sheet, the conveyor belt is moved in synchronism with the photosensitive body.

3 Claims, 6 Drawing Sheets

(A)

COLOR IMAGE FORMING APPARATUS HAVING A SYNCHRONIZED CONVEYOR

This application is a continuation of application Ser. No. 012,486, filed on Feb. 9, 1987, now abandoned.

BACKGROUND OF THE INVENTION

1. Field of the Invention:

The present invention relates to an image forming apparatus.

2. Description of the Prior Art:

Various image forming apparatus are known in the art. One such image forming apparatus is a color electronic copying machine including an endless belt positioned near a photosensitive body or drum and reciprocally movable for conveying a copy sheet thereon. In such a color electronic copying machine, a toner image formed on the photosensitive body by color separation is transferred in an image transfer section to the copy sheet upon forward movement of the endless belt. After all toner images in given colors have been transferred to the color sheet in superimposed relation, the toner images are fixed to the copy sheet to produce a colored copy (see, for example, Japanese Laid-Open Patent Publication No. 58-198062).

The toner images on the copy sheet are fixed thereto by an image fixing device which moves the copy sheet at a speed different from the speed of travel through the image transfer section in order to produce the amount of heat that is required to fuse the toner images. Generally, the speed at which the copy sheet moves through the image fixing device is lower than the speed of travel through the image transfer section.

Where the image fixing device comprises a heating roller and a pressing roller which are held in contact with each other at peripheral surfaces, the copy sheet delivered from the image transfer section, with the toner images thereon, tends to sag due to the different speeds upon arrival at the image fixing device. As a result, the toner images on the copy sheet are rubbed by the roller.

In producing a color copy, it is important that the toner images be successively transferred from the photosensitive body onto the copy sheet in exact registry. To meet such a requirement in a color copying machine in which a document support table for supporting a document to be copied is reciprocally movable, the document support table and the endless belt are moved in synchronism with each other.

Such synchronous operation will be described in greater detail with reference to FIGS. 7 and 8 of the accompanying drawings. A document support table 102 with a document 101 placed thereon and a conveyor belt 103 disposed below the document support table 102 are moved in synchronism with each other in opposite directions by a driving mechanism (not shown). Between the document support table 102 and the conveyor belt 103, which may be an endless belt, there are disposed an exposure device 104, a photosensitive belt 105 positioned beneath the exposure device 104 and movable in the direction of the arrow A, the photosensitive belt 105 having a confronting the exposure device 104 for exposure of an image of the document 101 through the exposure device 104, and an image developing device 106 disposed near the photosensitive belt 105 for developing an electrostatic latent image carried on the photosensitive belt 105 into a visible toner image.

An image transfer device (not shown) is disposed in a region where the photosensitive belt 105 confronts the conveyor belt 103 for transferring the developed image from the photosensitive belt 105 onto an image transfer sheet S such as a copy sheet which has been delivered by the conveyor belt 103.

When the document support table 102 is moved in the direction of the arrow in FIG. 7, the photosensitive belt 105 is exposed to a document image via the exposure device 104 to form an electrostatic latent image thereon. The electrostatic latent image on the photosensitive belt 105 is developed into a visible toner image by the image developing device 106. The visible toner image is then transferred electrostatically by the image transfer device onto the image transfer sheet S that travels in the direction of the arrow B on the conveyor belt 103.

In order to bring the leading end a of the image on the photosensitive belt 105 into registry with the leading end of the image transfer sheet S in FIG. 7, it is necessary that the leading end of the image transfer sheet S on the conveyor belt 103 be initially spaced from the position where it will contact the photosensitive belt 105 by a distance equal to the distance 1 from the exposure position via the image developing position to the image transfer position. Therefore, the conveyor belt 103 needs an additional length. After the trailing end al of the document 101 on the document support table 102 has been exposed as shown in FIG. 8, it is also necessary to move the document support table 102 by the distance 1 that the trailing end of the image on the photosensitive belt 105 moves from the exposure position to the image transfer position. The document support table 102 is thus required to move an additional stroke.

The additional length of the conveyor belt 103 and the additional stroke of travel of the document support table 102 are effective to prevent images from being displaced out of registry in a color copying machine in which images are superimposed on an image transfer sheet. However, the conveyor belt 103 requires an increased length, and, in addition, in case the copying machine is used in a monochoromatic copy mode, the sizes of the conveyor belt and the document support table are large as compared with the size of a document to be copied, with the result that the copying machine is of a large size.

SUMMARY OF THE INVENTION

It is therefore an object of the present invention to provide an image forming apparatus which will eliminate the danger of rubbing toner images on an image transfer sheet at the time the image transfer sheet with the toner images thereon reaches an image fixing device.

Another object of the present invention is to provide an image forming apparatus of a relatively small size in which the length of a conveyor belt is reduced by reducing the interval that the conveyor belt is moved with respect to the interval that a document support table is reciprocally moved.

Still another object of the present invention is to provide an image forming apparatus which can prevent images from being positioned out of registry when the images are to be superimposed on an image transfer sheet as in a color copy mode, and which can produce a copy of a larger document than a document in the color copy mode, as in a monochromatic copy mode in which no out-of-registry problem arises.

According to an embodiment of the present invention, an image forming apparatus includes a table driving system for driving a document support table, a fixing device driving system for driving an image fixing device, a first transmission system for transmitting driving power from the table driving system to a conveyor belt, and a second transmission system for transmitting driving power from the fixing device driving system to the conveyor belt. The first and second transmission systems are selectively operated at different speeds when an image is transferred to an image transfer sheet on the conveyor belt and when the image is fixed to the image transfer sheet by the image fixing device.

According to another embodiment of the present invention, a conveyor belt is stopped while a document support table is moving for a distance correposponding to a period of time after the document support table starts moving and a photosensitive body starts being exposed to a document image and until the image starts being transferred from the photosensitive body onto an image transfer sheet, and thereafter the conveyor belt is moved in synchronism with the document support table.

In accordance with still another embodiment of the present invention, an image forming apparatus includes a table driving system for driving a document support table, a driving system for driving a photosensitive body, a first transmission system for transmitting driving power from the table driving system to a conveyor belt, and a second transmission system for transmitting driving power from the photosensitive body driving system to the conveyor belt. The first transmission system is selected when toner images are successively transferred onto an image transfer sheet in superimposed relation, and the second transmission system is selected when a single or monochromatic image is transferred onto the image transfer sheet.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
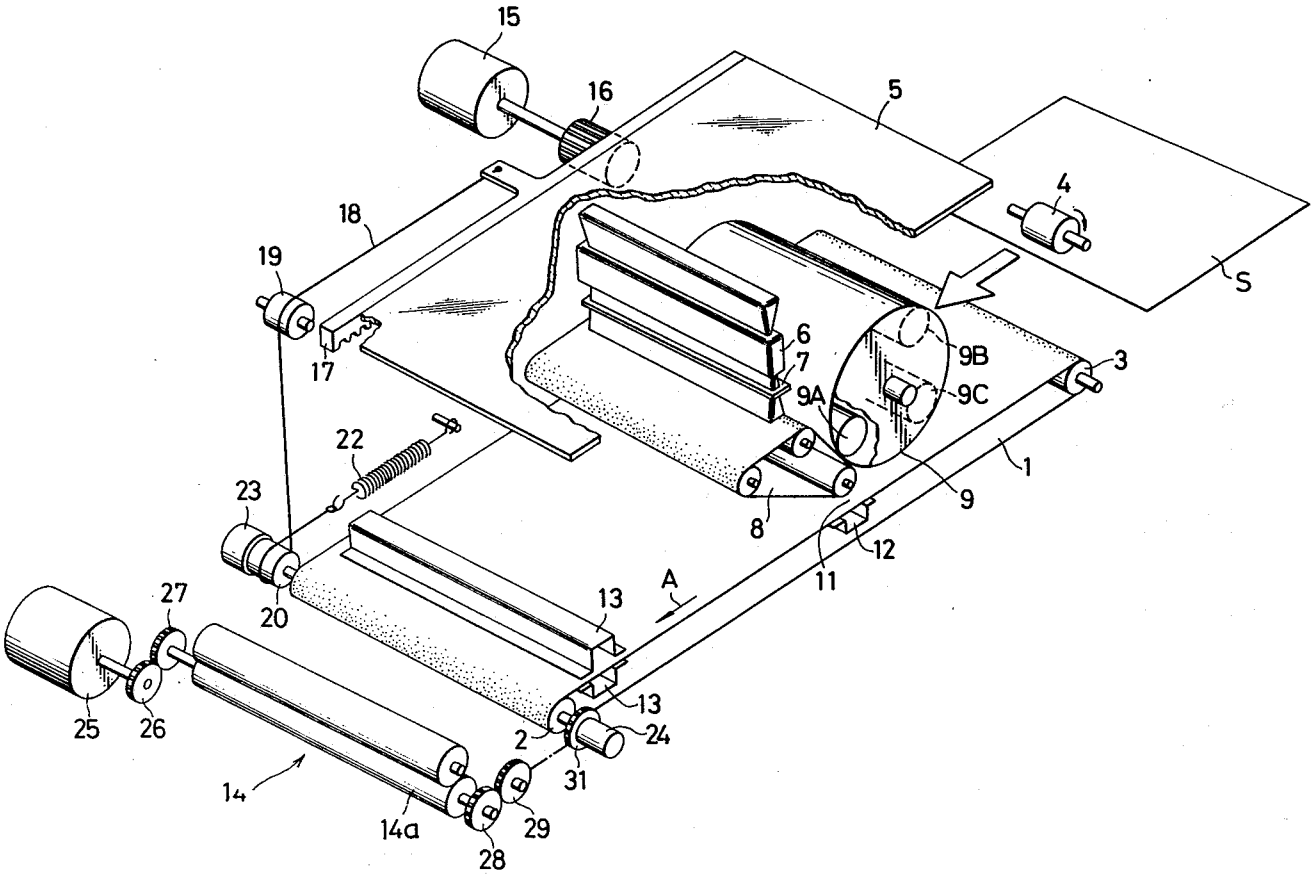
FIG. 1 is a schematic perspective view, partly broken away, of a driving system in an image forming apparatus according to the present invention.

Like or corresponding parts are denoted by like or correspondings reference characters throughout several views.

As shown in FIG. 1, an endless conveyor belt 1 is trained around a driver roller 2 and a driven roller 3 and tensioned in one direction. An image transfer sheet S delivered by a feed roller 4 is electrostatically attracted to the conveyor belt 1 and conveyed thereby in the direction of the arrow A. A document support table 5 is disposed above and extends parallel to the conveyor belt 1 for movement therealong. A color image of a document placed on the document support table 5 is focused as an optical image on a photosensitive belt 8 via a convergent light transmitting array 6 and filters 7 to form an electrostatic latent image on the photosensitive belt 8. A plurality of color images are successively produced by color separation, and electrostatic latent images corresponding to these color images are developed respectively by color toner developing sleeves 9A, 9B, 9C of an image developing device 9 which are selectively brought into an image developing section.

As the image transfer sheet S electrostatically attracted to the conveyor belt 1 is conveyed thereby through an image transfer section 11, the first developed image on the photosensitive belt 8 is transferred onto the image transfer sheet S by an image transfer charger 12. At this time, the upper run of the conveyor belt 1 is moved in the direction of the arrow A which is opposite to the direction of movement of the document support table 5 during exposure. After the exposure, the document support table 5 is moved back. After the trailing end of the image transfer sheet S has moved past the image transfer section 11, the conveyor belt 1 travels back to move the upper run thereof in a direction opposite to the direction of the arrow A in prepartion for the transfer of the next developed image.

The above process is repeated to transfer the second and then third developed images from the photosensitive belt 8 successively onto the image transfer sheet S in superimposed relation in exact registry.

After the final, or third, developed image has been transferred, the image transfer sheet S is moved through erasure chargers 13 to an image fixing device 14 composed of a pair of rollers and positioned at an outlet end of the conveyor belt 1. The images on the image transfer sheet S are fixed thereto by the image fixing device 14, and then the image transfer sheet S is discharged out of the color copying machine. The document support table 5, the convergent light transmitting array 6, and the filters 7 jointly constitute an image forming system, the document support table 5 being reciprocally movable portion thereof as described above.

A rack 17 is fixed to and along one side of the document support table 5 and held in mesh with a pinion 16 coupled to an electric motor 15 rotatable in opposite directions. The rack 17, the pinion 16, and the motor 15 jointly serve as a table driving system. When the motor 15 rotates in opposite directions, the document support table 5 is moved back and forth through the pinion 16 and the rack 17. A wire 18 has one end secured to the document support table 5 and is trained around an idle pulley 19 and a pulley 20 of the driver roller 2. The other end of the wire 18 is fixed to one end of a tension spring 22. When the motor 15 rotates in opposite directions to move the document support table 5 reciprocally, the pulley 20 is rotated by the wire 18 to move the conveyor belt 1 back and forth at a first speed in synchronism with the document support table 5. The wire 18, the pulley 19, the pulley 20, and the spring 22 jointly constitute a first transmission system for transmitting the rotation of the table driving system to the conveyor belt 1 to drive the same in synchronism with the document support table 5. The pulley 20 is coupled to a clutch 23 of the first transmission system.

The image fixing device 14 includes a fixing roller 14*a* fixed at one end to a gear 28 meshing with an idle gear 29 that is operatively coupled to a gear 31 fixed axially to the driver roller 2. Thus, rotation of the gear 28 is transmitted to the gear 31. The gears 28, 29, 31 jointly serve as a second transmission system, which also includes a clutch 24 coupled to the gear 31.

While an image is being formed on the photosensitive belt 8 and transferred therefrom onto the image transfer sheet S, the clutch 23 is connected and the clutch 24 is disconnected. Therefore, the conveyor belt 1 is driven by the first transmission system so as to be rotated in opposite directions in synchronism with the document support table 5. Hence, no relative displacement occurs between the document on the document support table 5 and the image transfer sheet on the conveyor belt 1.

When the images are fixed to the image transfer sheet S, i.e., after the final image has been transferred, the clutch 23 is disconnected and the clutch 24 is connected. The conveyor belt 1 is now driven by the second transmission system to move in the direction of the arrow A at a second rate or linear speed equal to the speed of operation of the image fixing device 14.

Thus the conveyor belt 1 is driven selectively at different speeds in the image transfer and fixing periods. In the process of forming an image, the document support table 5 and,, the conveyor belt 1 are synchronously moved at a first speed to provide exact registry between the document and the image transfer sheet. When an image is fixed, the conveyor belt 1 is driven at a linear speed equal to the speed of operation of the image fixing device 14, so that the image transfer sheet as it is delivered from the conveyor belt 1 to the image fixing device 14 is prevented from sagging, and the images are prevented from being rubbed by the fixing roller. After the final image has been transferred onto the image transfer sheet, it is not necessary to bring the speed of operation of the image fixing device into conformity with the rate of image formation. Thus, the image transfer sheet can be delivered slowly through the image fixing device for better image fixing. Moreover, flexibility can be given to the movement of the conveyor belt 1 which is limited by the reciprocating stroke of the document support table 5.

Figure 2:
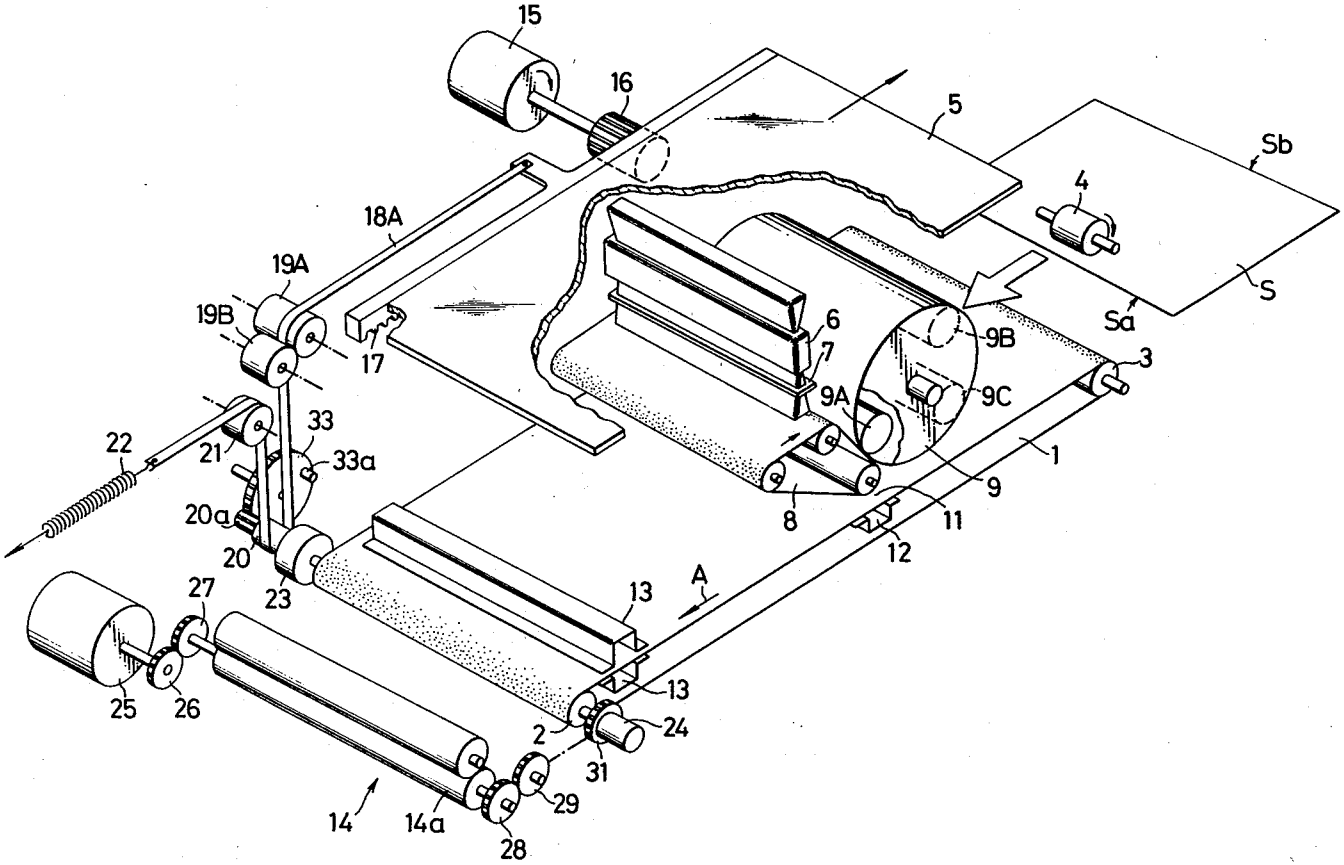
FIG. 2 is a schematic perspective view, partly broken away, of a driving system in an image forming apparatus according to another embodiment of the present invention.

FIG. 2 shows a driving system according to another embodiment of the present invention. The driving system of FIG. 2 differs from that of FIG. 1 in that a timing belt 18A is fixed to the document support table 5 and a different mechanism is employed for driving the timing belt 18A.

More specifically, the timing belt 18A with its one end secured to the document support table 5 is sandwiched between pulleys 19A, 19B and trained around a pulley 20 coupled to a clutch 23 and a pulley 21. The other end of the timing belt 18A is fastened to one end of a tension spring 22. As the motor 15 is rotated in the direction of the arrow, the document support table 5 is moved in the direction of the arrow, or a forward direction. At the same time, the timing belt 18A is pulled to rotate the pulley 20, thus moving the upper run of the conveyor belt 1 in the direction of the arrow A. The spring 22 is pulled to store energy. At this time, the clutch 23 is connected, whereas the clutch 24 is disconnected.

Upon movement of the document support table 5 over a prescribed stroke, the trailing end Sb of the image transfer sheet S on the conveyor belt 1 has been moved out of the image transfer section 11. The motor 15 is now reversed to move back the document support table 5. The stored energy of the spring 22 is released to pull the timing belt 18A toward the spring 22. The pulley 20 is rotated in the opposite direction to move the upper run of the conveyor belt 1 in the direction opposite to the direction of the arrow A for returning the image transfer sheet S back to the position prior to the image transfer. The above cycle of operation is thereafter repeated twice to transfer the images of given colors on the image transfer sheet S in superimposed fashion.

The lower roller 14*a* of the image fixing device 14 is driven by a motor 25 through intermeshing gears 26, 27. As the roller 14*a* is driven, the gear 31 is rotated through the intermeshing gears 28, 29. Upon completion of the transfer of the final image, the clutch 23 is disconnected and the clutch 24 is connected to drive the conveyor belt 1 through the gears 28, 29, 31. Thus, the image transfer sheet S is delivered by the conveyor belt 1 toward the image fixing device 14 at a rate or linear speed equal to the speed of operation of the image fixing device 14.

As shown in FIG. 2, the pulley 20 has an integral pinion 20*a* meshing with a larger-diameter gear 33 having a pin 33*a*.

Figure 3:
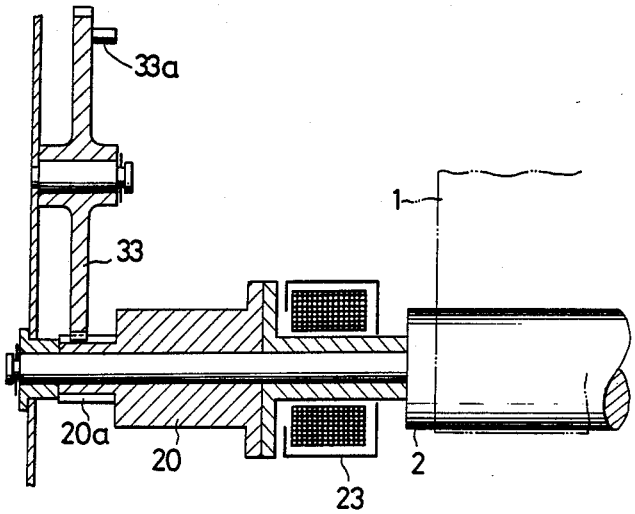
FIG. 3 is an enlarged fragmentary cross-sectional view of the driving system shown in FIG. 2.

FIG. 3 shows the pulley 20, the pinion 20*a* the gear 33, and the pin 33*a* on an enlarged scale. The pin 33*a* of the larger-diameter gear 33 will engage a stopper (described later) to limit the angular movement of the gear 33, with the result that the rotation of the driver shaft 2 upon engagement of the clutch 23 is limited to limit the interval of travel of the conveyor belt 1.

Figure 4:
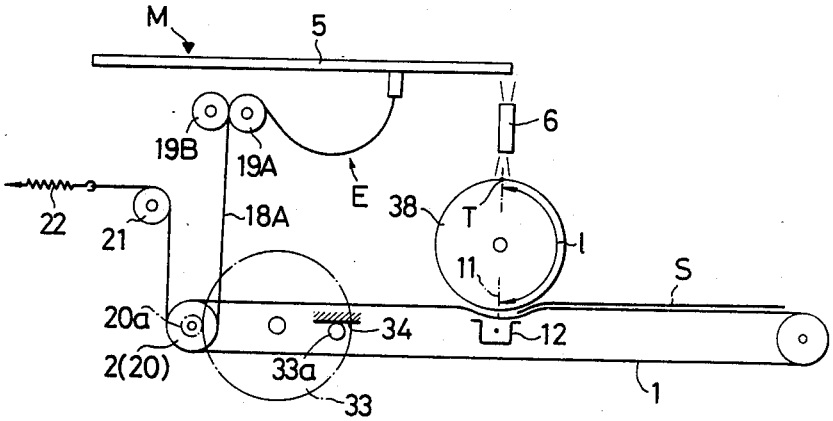
FIGS. 4A through 4C are schematic side elevational views showing the manner in which the driving system of FIG. 2 operates.
Figure 4B:
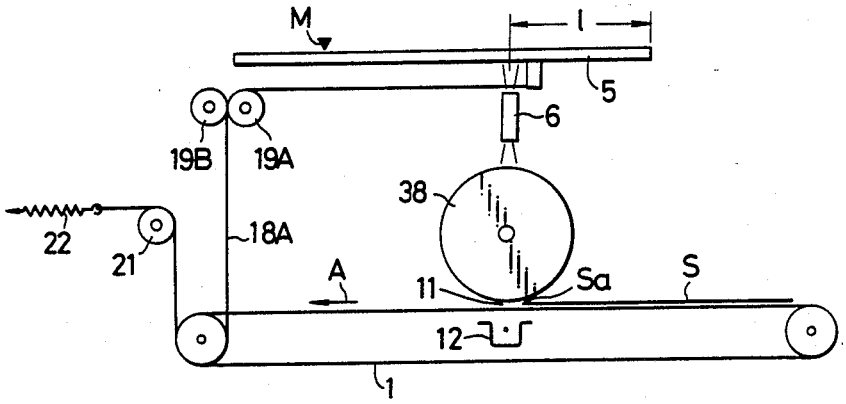
Figure 4C:
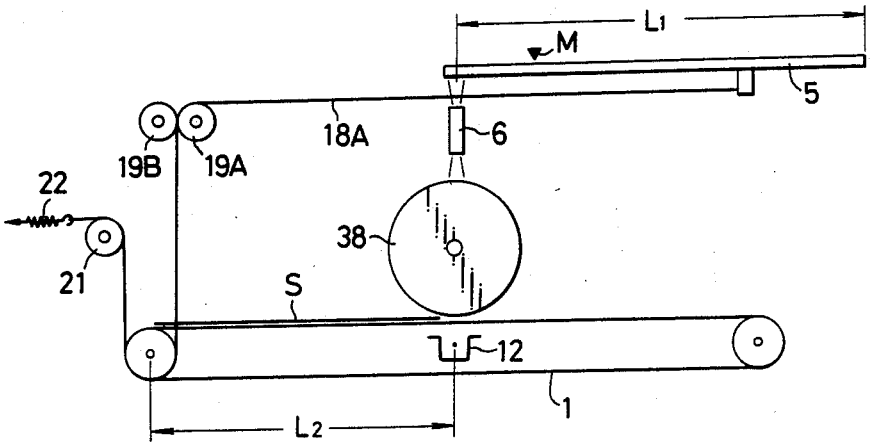

The relative driven displacement of the conveyor belt 1 and the document support table 5 is illustrated in FIGS. 4A through 4C. In FIGS. 4A through 4C, a photo-sensitive drum 38 is employed in place of the photosensitive belt 8.

When the document support table 5 is moved back to the left by reverse rotation of the motor 15, the timing belt 18A is pulled by the spring 22 to move the upper run of the conveyor belt 1 in the direction opposite to the direction of the arrow A. The larger-diameter gear 33 is rotated counterclockwise to bring the pin 33 into engagement with a stopper 34 as shown in FIG. 4A, whereupon the conveyor belt 1 is stopped. At this time, the document support table 5 is in a forward movement starting position, and the image transfer sheet S is positioned on the conveyor belt 1 as illustrated. In the position of FIG. 4A, the timing belt 18A sags for a length 1 in an area E. The timing belt 18A and the pulley 20 are however in proper mesh with each other since the timing belt 18A is gripped under tension between the pulleys 19A, 19B. Denoted at M in FIG. 4A is the trailing end of the document on the document support table 5.

When the document support table 5 reaches the position of FIG. 4B from the forward movement starting position of FIG. 4A, i.e., when an exposure starting point T on the photosensitive drum 38 reaches the image transfer section 11, the sag of the timing belt 18 is taken up or eliminated. Now, the leading end of the toner image on the photosensitive drum 38 and the leading end Sa of the image transfer sheet S coincide with each other, and at the same time the timing belt 18A as it is kept taut starts to drive the conveyor belt 1 to move the upper run thereof in the direction of the arrow A. The document support table 5 and the conveyor belt 1 are put to a stop in the position of FIG. 4C.

After the image of the trailing end of the document has been formed on the photosensitive drum 38, the document support table 5 moves the additional distance 1. In FIG. 4C, L1 denotes the interval which the document support table 5 has moved, and L2 denotes the interval which the conveyor belt 1 has traveled.

In the embodiment of FIG. 2, the timing belt 18A may be replaced with a wire.

According to the embodiment of FIG. 2, the timing belt 18A is given a sag corresponding to the length 1 to shut off rotation from the table driving system to the conveyor belt 1, thereby stopping the conveyor belt 1, while the document support table 5 is moved a distance corresponding to a period of time from the transmission of the power from the table driving system to start moving the document support table 5 in the forward direction and exposing the photosensitive belt 8 or drum 38 up to the image transfer. Thereafter, the conveyor belt 1 is driven in synchronism with the document support table 5.

With this embodiment, the length of the conveyor belt 1 is reduced by an amount corresponding to the distance on the photosensitive belt or drum, which is commensurate with the time period between the exposure and the image transfer. Therefore, a color recording apparatus such as a color copying machine or a color printer incorporating the conveyor belt therein may be reduced in size.

Figure 5:
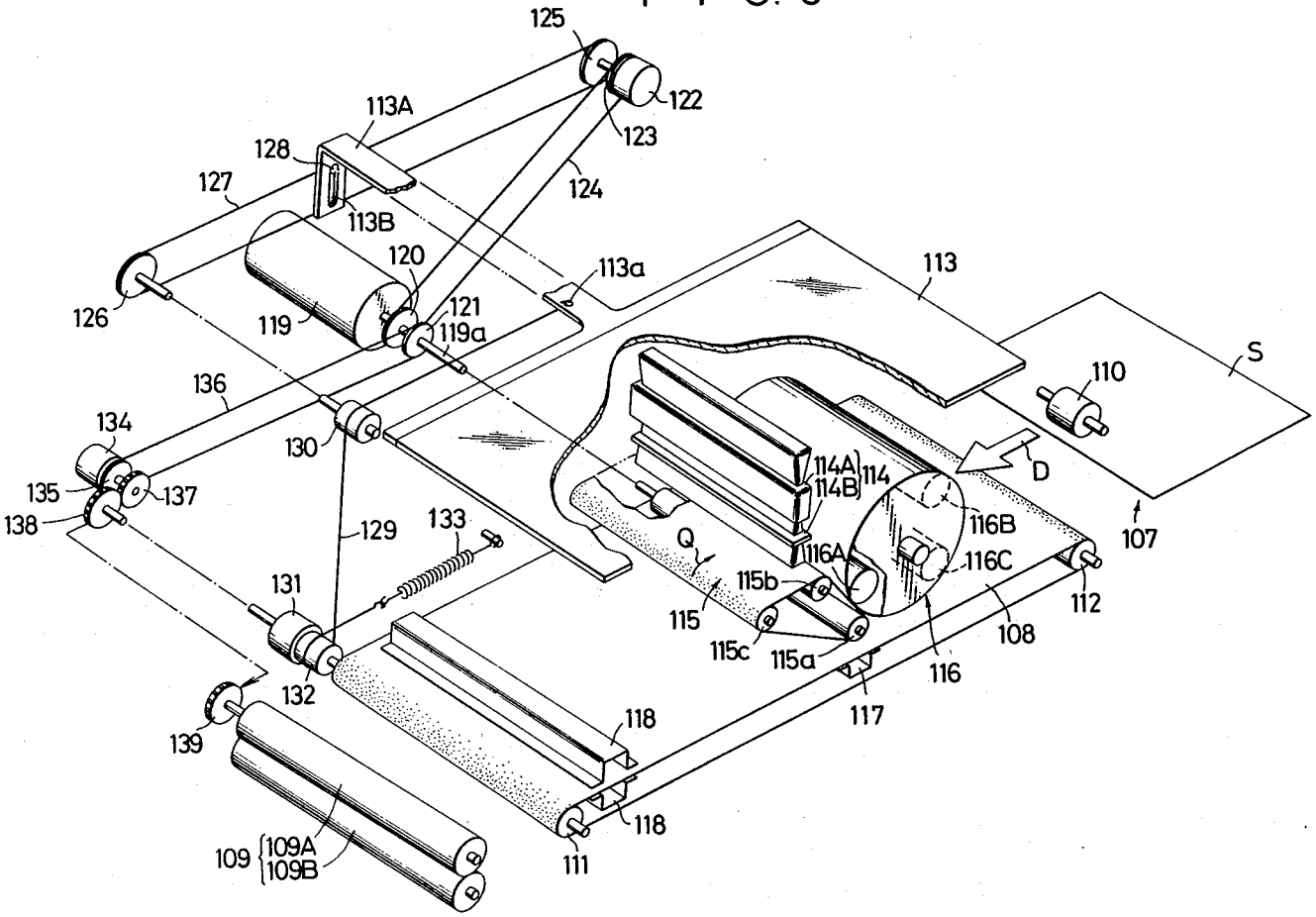
FIG. 5 is a schematic perspective view, partly broken away, of a driving system in an image forming apparatus according to still another embodiment of the present invention.

FIG. 5 shows a driving system according to still another embodiment of the present invention, in which a single motor is employed for driving a document support table and a conveyor belt.

In FIG. 5, a color copying machine includes a sheet feeder 107, a conveyor belt 108, and an image fixing device 109 arranged in the direction of the arrow D in which an image transfer sheet S is fed.

The sheet feeder 107 has a feed roller 110 capable of engaging the uppermost one of stacked image transfer sheets S contained in a sheet cassette (not shown). The image transfer sheet S can be delivered in the direction of the arrow D upon rotation of the feed roller 110.

Figure 7:
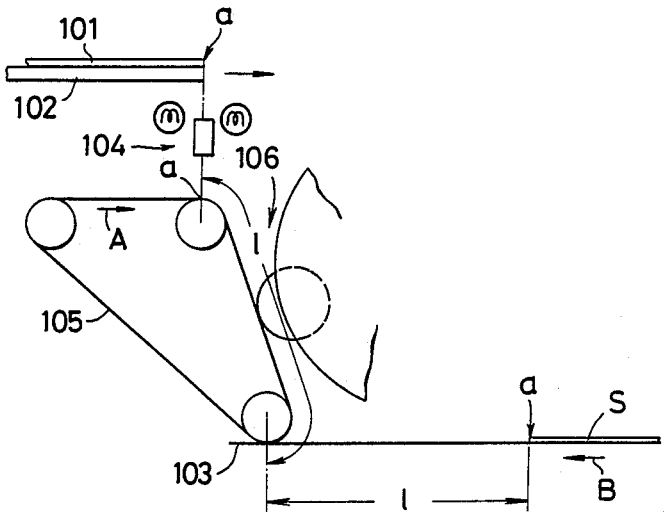
FIGS. 7 and 8 are schematic side elevational views showing the relationship between the ends of a document on a document support table and an image transfer sheet on a conveyor belt in the case where a photosensitive belt is employed.

The conveyor belt 108 comprises an endless belt trained around driver and driven rollers 111, 112 spaced from and aligned with each other in the direction of the arrow D. The conveyor belt 108 has a length in the direction of the arrow D, which includes the length 1 shown in FIG. 7.

An image forming system is disposed above the conveyor belt 108 and includes a document support table 113 reciprocally movable in the direction of the arrow D. Between the document support table 113 and the conveyor belt 108, there are disposed an exposure device 114 having a convergent light transmitting array 114A and filters 114B, and a photosensitive belt 115 positioned beneath the exposure device 114 and trained around pulleys **115*a*, 115*b*, 115*c* for travel in the direction of the arrow Q. A cylindrical image developing device 116 is rotatably disposed in the vicinity of the photosensitive belt 115 at a position following an exposure position between the exposure device 114 and the photosensitive belt 115. The image developing device 116 has a plurality of color toner developing sleeves 116A, 116B, 116C storing developers or toners of different colors and angularly spaced from each other. An image transfer device 117 is located between the upper and lower runs of the conveyor belt 108 below the photosensitive belt 115. Erasure chargers 118 are disposed near the driver roller 111 in sandwiching relation to the upper run of the conveyor belt 108**.

The image fixing device 109 comprises a pair of rollers 109A, 109B confronting each other and disposed in sandwiching relation to the feed path for the image transfer sheet S, which is defined by the conveyor belt 108.

The document support table 113 and the conveyor belt 108 are driven in synchronism with each other by a first transmission system, and the photosensitive belt 115 and the conveyor belt 108 are driven in synchronism with each other by a second transmission system.

The first and second transmission systems have a common drive source 119 in the form of an electric motor having a driving output shaft **119*a* directly coupled coaxially to the driver pulley 115*a* of the photosensitive belt 115. Pulleys 120, 121 are fixedly mounted on the output shaft 119*a* of the motor 119**.

The pulley 120 serves as a driver pulley of the first transmission system. A wire 124 is trained around the pulley 120 and a driven pulley 123 coupled to a clutch 122. A pulley 125 is supported coaxially with the driven roller 123. A wire 127 is trained around the pulley 125 and a pulley 126 which is spaced from and aligned with the pulley 125 in the direction of reciprocating movement of the document support table 113. A pin 128 fixed to the wire 127 is fitted in a vertical slot 113B defined in a vertical arm of an angle member 113A extending from one side of the document support table 113. Therefore, the document support table 113 can be moved back and forth in response to movement of the wire 127.

The clutch 122 is engaged to rotate the driven pulley 123 and the pulley 125 together during a color copy mode until a final image is transferred from the photosensitive belt 115 onto the image transfer sheet S and also during a monochromatic copy mode. As long as the clutch 122 is connected, the document support table 113 is operated to allow the photosensitive belt 115 to be exposed to the image of the document on the document support table 113.

The angle member 113A has a hole **113*a* defined therein near the document support table 113. A wire 129 has an end engaging in the hole 113*a* and is trained around an idle pulley 130 coaxial with the pulley 126. The wire 129 is trained around a pulley 132 coupled to a clutch 131 supported coaxially with the driver roller 111. The other end of the wire 129 is joined to a tension spring 133**.

The pulley 121 on the motor shaft **119*a* serves as a driver pulley of the second transmission system. A wire 136 is trained around the pulley 121 and a driven pulley 135 directly coupled to a clutch 134. A gear 137 is supported coaxially with the driven pulley 135 and meshes with a gear 138 supported on the shaft of the driver pulley 111 and held in mesh with a gear 139 supported on the shaft of the upper roller 109A of the image fixing device 109**.

The clutches 131, 134 of the first and second transmission systems, respectively, control the transmission of rotation to the driver roller 111 for the conveyor belt 108 dependent on the copy modes. More specifically, the clutch 131 is engaged to connect the driver roller 111 and the pulley 132 in the color copy mode, and is disengaged to disconnect the driver roller 111 and the pulley 132 from each other in the monochromatic copy mode and also in the color copy mode when the final image has been transferred. The clutch 134 is disengaged to disconnect the gear 137 from the pulley 135 when the clutch 131 is connected. The clutch 134 is engaged to connect the gear 137 to the pulley 135 when the clutch 131 is disconnected.

Therefore, when the clutch 131 is connected, the driver roller 111 is rotated in opposite directions by back-and-forth movement of the document support table 113 through the wire 129 and the pulley 132. When the clutch 131 is disconnected, the driver roller 111 is rotated in one direction by the motor 119 through the wire 136 and the gears 137, 138.

In the color copy mode in which images of different colors are superimposed on the image transfer sheet S, the clutches 122, 131 are connected, and the clutch 134 is disconnected. The rotation of the motor 119 is transmitted to the driver pulley 115*a* of the photosensitive belt 115 and also to the pulley 125 to drive the wire 127. Consequently, the photosensitive belt 115 is driven and the document support table 113 is moved reciprocally. At the same time, the conveyor belt 108 is moved back and forth in synchronism with the document support table 113 through the wire 129, the pulley 132, and the driver roller 111.

The image transfer sheet S from the sheet feeder 107 is delivered in the direction of the arrow D by the conveyor belt 108 into an image transfer section below the photosensitive belt 115. In the image transfer section, the first developed image on the photosensitive belt 115 is transferred by the image transfer device 117 onto the image transfer sheet S. After the first developed image has been transferred, the document support table 113 and the conveyor belt 108 are moved back to their initial positions.

The above process is repeated to transfer the second and then third developed images from the photosensitive belt 115 onto the image transfer sheet S.

Upon completion of the transfer of the final developed image, the clutches 122, 131 are disconnected, and the clutch 134 is connected. Now, the rotation of the motor 119 is transmitted to the driver pulley 115*a* to the driver roller 111 via the gears 137, 138, and also to the upper roller 109A of the image fixing device 109 via the gears 137, 138, 139. The image transfer sheet S is therefore fed by the conveyor belt 108 through the erasure charger 118 to the image fixing device 109.

Figure 6:
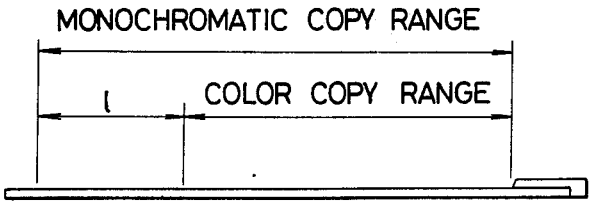
FIG. 6 is a schematic front elevational view explaining operation of the driving system illustrated in FIG. 5.

In the monochromatic copy mode, the stroke 1 (FIG. 8) which the document support table 113 is required to move in the color copy mode can be utilized as a range for placing the document therein, as shown in FIG. 6. Such a range corresponding to the stroke 1 and the color copy range are added to provide a larger region in which the document can be scanned.

Figure 8:
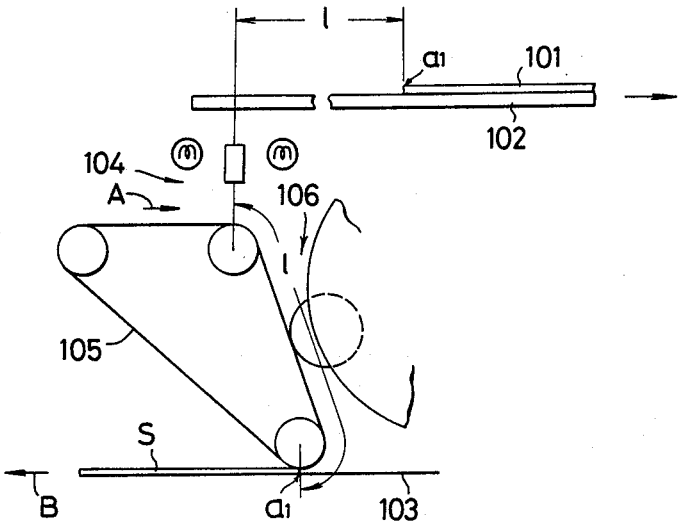

More specifically, the document support table 113 is moved additionally in the scanning direction of the document image by the distance corresponding to the distance 1 which the photosensitive belt is moved, as shown in FIG. 8, in order to bring the leading end of the image into conformity with the leading end of the image transfer sheet to eliminate out-of-registry conditions of the images in the color copy mode. This additional region 1 is added as a document scanning region.

In the monochromatic copy mode, it is not necessary to synchronize the document support table 113 and the conveyor belt 108 as in the color copy mode, and only synchronization between the photosensitive belt 108 and the image transfer sheet S is required. In this mode, the clutch 131 is disconnected, and the clutches 122, 134 are connected. The rotation of the motor 119 is transmitted to the driver pulley 115*a*, the driver roller 111, and the upper roller 109A of the image fixing device 109.

The document scanning region with the region 1 added is scanned by the exposure device 114, and an electrostatic latent image is formed on the photosensitive belt 115 by such a scanning process. The electrostatic latent image is then developed into a visible toner image.

The image transfer sheet S from the sheet feeder 107 is conveyed by the conveyor belt 108 to the image transfer position. The conveyor belt 108 is synchronized with the photosensitive belt 115 to allow the developed image to be transferred from the photosensitive belt 115 onto the image transfer sheet S.

With the embodiment shown in FIG. 5, the first transmission system for synchronously driving the conveyor belt 108 and the document support table 113 and the second transmission system for synchronously driving the photosensitive belt 115 and the conveyor belt 108 are selectively actuated dependent on the copy modes. In the color copy mode, images of different colors can be transferred to the image transfer sheet S in superimposed relation in exact registry. In the monochromatic copy mode, a document of a larger size than a document that can be copied in the color copy mode can be copied.

Although certain preferred embodiments have been shown and described, it should be understood that many changes and modifications may be made therein without departing from the scope of the appended claims.

What is claimed is:

1. An image forming apparatus comprising:

an image forming system for forming an image of a document;

an image transfer device for transferring the image from said image forming system onto an image transfer sheet;

an endless conveyor belt extending in a direction for conveying the image transfer sheet to said image transfer device;

an image forming system driving system for reciprocally moving a portion of said image forming system along said direction;

an image fixing device disposed at an outlet end of said endless conveyor belt for fixing the transferred image to said image transfer sheet;

a fixing device driving system for driving said image fixing device;

a first transmission system for transmitting driving power from said image forming system driving system to said conveyor belt at a first speed to operate the conveyor belt in synchronism with said image forming system; and a second transmission system for transmitting driving power from said fixing device driving system to said conveyor belt to operate the conveyor belt at a second speed in synchronism with said fixing device driving system, said first transmission system being actuatable when the image is being transferred from said image forming system onto the image transfer sheet, and said second transmission system being actuatable when the image is being fixed to the image transfer sheet, wherein said image forming system comprises:

a photosensitive body;

means for exposing said photosensitive body to successive images in different colors in a color separation operation, thereby to form latent images successively on said photosensitive body; and means for developing said latent images successively into visible images of different colors;

wherein said conveyor belt comprises means for conveying said image transfer sheet in successive reciprocating strokes to allow the visible images to be successively transferred from said photosensitive body onto said image transfer sheet in synchronization with the respective reciprocating strokes;

wherein said first transmission system is capable of shutting off transmission of driving power while said portion of said image forming system is moving for a distance corresponding to a period of time from after the portion of said image forming system starts moving and said photosensitive body starts being exposed to until the image starts being transferred from said photosensitive body onto said image transfer sheet, and thereafter of driving said conveyor belt in synchronism with said portion of said image forming system.

2. The image forming apparatus of claim 1, further comprising:

a photosensitive body driving system for driving said photosensitive body.

3. A color image forming apparatus comprising:

a color image forming system movable in a direction for forming a color image of a document;

an image transfer device for transferring the color image from said color image forming system onto an image transfer sheet;

an endless conveyor belt extending in a direction for conveying the image transfer sheet to said image transfer device;

an image forming system driving system for reciprocally moving a portion of said color image forming system along said direction;

an image fixing device disposed at an outlet end of said endless conveyor belt for fixing the transferred image to said image transfer sheet;

a fixing device driving system for driving said image fixing device;

a first transmission system for transmitting driving power from said image forming system driving system to said conveyor belt at a first speed to operate the conveyor belt in synchronism with said color image forming system; and a second transmission system for transmitting driving power from said fixing device driving system to said conveyor belt at a second speed in synchronism with said fixing device driving system, said first transmission system being actuatable when the image is transferred from said color image forming system onto the image transfer sheet, and said second transmission system being actuatable when the image is fixed to the image transfer sheet, wherein when said endless conveyor belt is moved by said first transmission system, in a first direction which is the same as that of said color image forming system, in an image transfer section where said endless conveyor belt faces said image forming system, a color toner image on said color image forming system is transferred onto the image transfer sheet, and when a trailing end of the image transfer sheet passes over said image transfer section, said endless conveyor belt is moved in a second direction opposite to said first direction so that said image transfer sheet is advanced upstream of said image transfer section relative to said first direction to provide a reciprocating movement of said endless conveyor belt, and said reciprocating movement of said endless conveyor belt is repeated so as to form the color toner image on said image transfer sheet and when said endless conveyor belt is moved by said second transmission system, said color toner image is fixed to the image transfer sheet by said image fixing device; and control means for controlling said first and second transmission systems such that said endless conveyor belt is moved in said first direction after a final color image is transferred onto said image transfer sheet, thereby guiding said image transfer sheet into said image fixing device.

* * * * *